US006748895B2

(12) United States Patent
Besenzoni

(10) Patent No.: US 6,748,895 B2
(45) Date of Patent: Jun. 15, 2004

(54) TELESCOPIC GANGWAY FOR BOATS WITH A SIMPLIFIED CONSTRUCTION

(75) Inventor: Giovanni Besenzoni, Sarnico (IT)

(73) Assignee: Besenzoni S.r.l., Sarnico-Bergamo (IT)

( * ) Notice: Subject to any disclaimer, the term of this patent is extended or adjusted under 35 U.S.C. 154(b) by 0 days.

(21) Appl. No.: 10/226,881

(22) Filed: Aug. 23, 2002

(65) Prior Publication Data

US 2003/0041792 A1 Mar. 6, 2003

(30) Foreign Application Priority Data

Sep. 5, 2001 (IT) ..... MI2001A1864

(51) Int. Cl.[7] ..... B63B 17/00
(52) U.S. Cl. ..... 114/362; 114/343
(58) Field of Search ..... 114/362, 343; 14/65.5, 71.1, 71.3, 71.7

(56) References Cited

U.S. PATENT DOCUMENTS 3,570,029 A * 3/1971 Hunsaker ..... 114/362
3,571,836 A * 3/1971 Dunlap ..... 14/71.1
4,354,447 A * 10/1982 Hultgren ..... 114/255
5,077,852 A * 1/1992 Karlsson ..... 14/69.5
5,244,335 A * 9/1993 Johns ..... 414/537

FOREIGN PATENT DOCUMENTS

EP 0 879 172 B1 * 11/1999

* cited by examiner

*Primary Examiner*—Sherman Basinger
(74) *Attorney, Agent, or Firm*—Hedman & Costigan, P.C.

(57) ABSTRACT

A telescopic gangway (10) for boats (12) with a simplified construction, of the type comprising at least two portions (30, 50) telescopically foldable, in which a second portion (50) slides inside at least a first portion (30) of the gangway (10), in a longitudinal direction thereto, wherein said second portion (50) is equipped with a central supporting structure (52), which slides on another central supporting structure (32) of the first portion (30); these two central structures (30, 50) are equipped with reciprocal sliding guides (60) and longitudinal appendages (40) complementary to these.

7 Claims, 5 Drawing Sheets

TELESCOPIC GANGWAY FOR BOATS WITH A SIMPLIFIED CONSTRUCTION

The present invention relates to a telescopic gangway for boats with a simplified construction.

Landing gangways occupy an important position among nautical accessories.

They are used to allow easy passage between boats and piers.

FIELD OF THE INVENTION

They generally have a rectangular flat surface, wide enough to allow a person to cross and long enough to allow the boat to be moored to the pier at a safe distance.

BACKGROUND OF THE INVENTION

There are numerous types of construction and materials used.

There are manual and automatic gangways, depending on whether they are positioned between the boat and pier manually or with movements obtained by hydraulic cylinders.

The choice of materials derives from technical and aesthetic considerations, respecting functional demands. Polished AISI 316 stainless steel, stainless steel painted with epoxy products, light corrosion-resistant alloys with various degrees of surface finishing, temperate crystals, teak and technological polymers, are therefore used.

To complete the gangway, vertical rods, called stanchions in nautical terminology, connected by ropes, which help and support people crossing the gangway, can also be included on at least one side of the gangway.

Furthermore there may also be a swivel joint at one end of the gangway, connected to the boat, to allow the gangway to be lifted or rotated for positioning it on the boat when sailing.

Telescopically foldable gangways, generally automatic, are particularly used, especially due to the fact that they require minimum space on the boat.

These gangways are formed by subdividing the total walking length into two or more pre-established length portions. These portions are so formed that one or more of them can be inserted into another portion or into other nearby portions.

In this way, in the case of a telescopic gangway with two portions, the possibility of overlaping the two elements considerably reduces the amount of space during sailing.

In some cases, they are completely foldable which means that, when telescopically inserted, they can be fitted into appropriate housings built into the boats.

The known construction technique is to include, on each portion of the gangway, on each side, a tubular element which can be telescopically inserted into that of the adjacent portion.

Furthermore, these elements also have a supporting function as they sustain a central footboard which can be crossed by a person.

This system, however, makes the telescopic gangway rather heavy and this creates various disadvantages.

For example, as the gangway is generally carried by the boat during sailing, its weight is added to the total weight of the boat.

In addition, as the moving of the gangway requires the use of cylinders whose size depends on its weight, these cylinders will have characteristics and costs of a certain significance.

An objective of the present invention is therefore to overcome the above drawbacks and in particular to produce a telescopic gangway for boats with a simplified construction and limited weight.

Another objective of the present invention is to produce a telescopic gangway for boats, having an essentially light structure and an opening mechanism which is easy to use.

SUMMARY OF THE INVENTION

Yet another objective of the present invention is to create a telescopic gangway for boats with a simplified construction, which is particularly reliable, simple, functional and at relatively low costs.

These and other objectives according to the present invention are achieved by the production of a telescopic gangway for boats with a simplified construction as described in claim 1.

Further characteristics are illustrated in the subsequent claims.

The characteristics and advantages of a telescopic gangway for boats with a simplified construction, according to the present invention, can be clearly understood from the following illustrative and non-limiting description.

Figure 1:
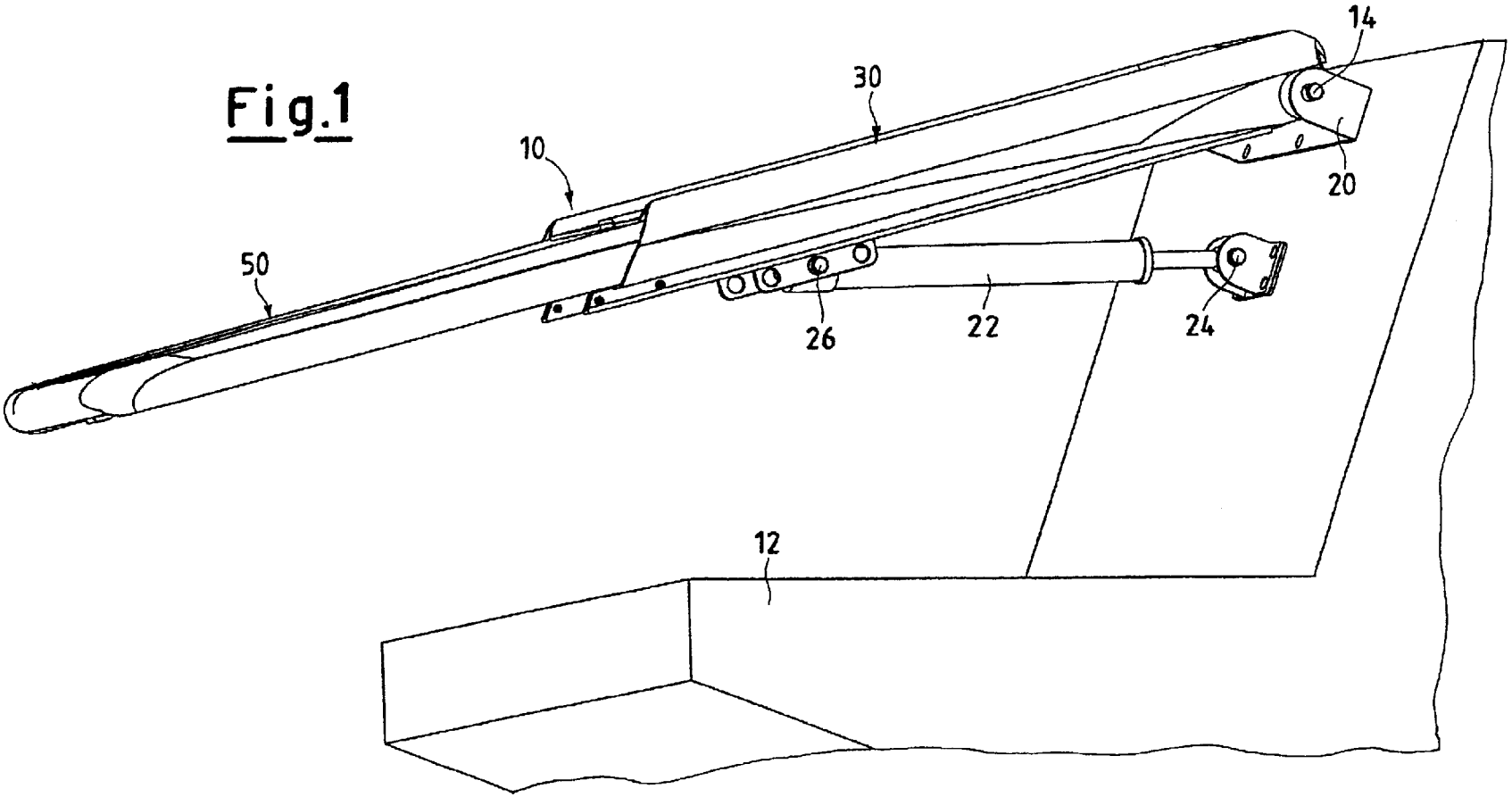
FIG. 1 is an axonometric view of a telescopic gangway for boats with a simplified construction, according to the present invention, connected to a boat.
Figure 2:
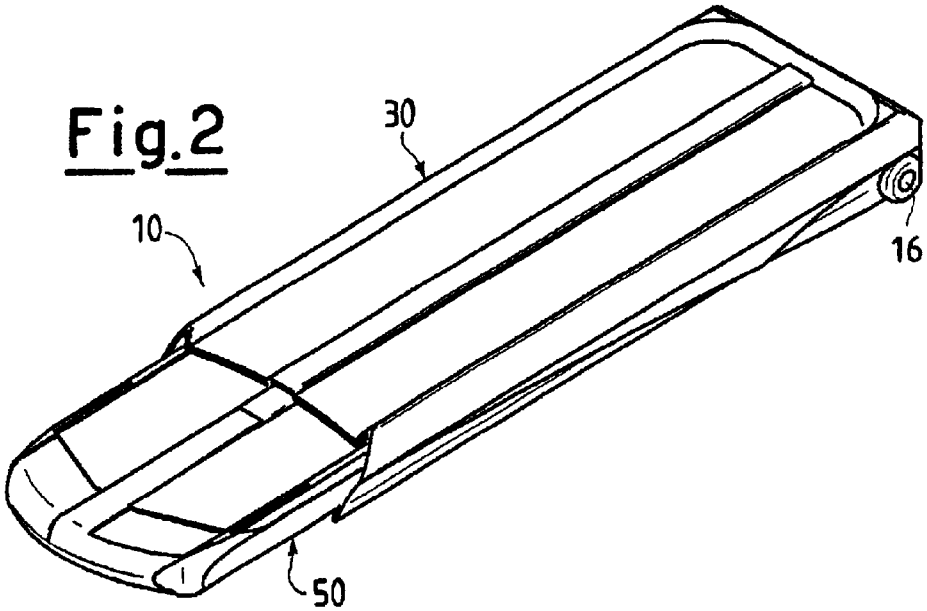
FIG. 2 is an axonometric view of the telescopic gangway alone of FIG. 1, where the two telescopic portions are clearly visible.

With reference to the figures, these show a telescopic gangway for boats with a simplified construction, indicated as a whole with 10, which can be used for the mooring of a boat 12 to a quay or jetty for disembarkation or boarding, and/or the haulage of tenders or water-scooters.

This connection is such that the gangway 10 can be rotated into a rest position, by means of a cylindrical pin 14 which runs through a hole 16, situated at the end of the gangway 10, and whose fulcrum is in correspondence with a "U"-shaped clamp 20, fixed to the boat 12.

DETAILED DESCRIPTION OF THE INVENTION

The rotation of the gangway 10 around the axis of the pin 14, enabling it to be arranged in a rest or functioning position respectively, is effected by means of a hydraulic cylinder 22, rotatingly fixed at its first end 24 to the boat 12, under the clamp 20, and at its second end 26, opposite to the first, to the gangway 10.

The gangway 10 in the example illustrated, according to the present invention, essentially comprises a first portion 30 and a second portion 50, telescopically foldable, in the sense that it can slide along one of its longitudinal axes and can be inserted into this first portion 30.

Figure 5:
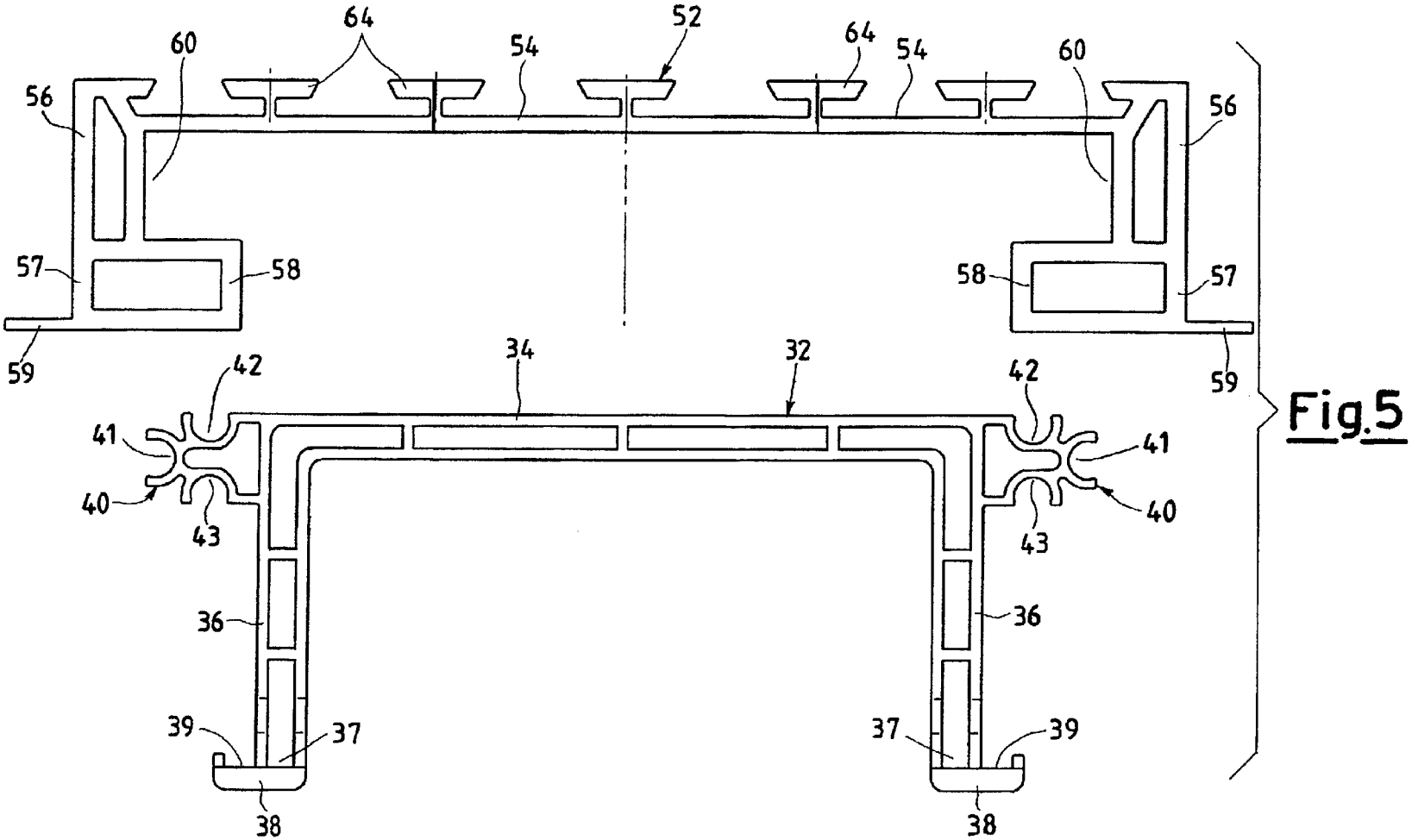
FIG. 5 is a blow-up of the section of FIG. 4.

As can be clearly seen in FIG. 5, the first portion 30 has a first central structure 32, effected by means of an overturned "U"-shaped draw piece, with an upper rectangular base 34 and two lateral portions 36, symmetrical to each other and perpendicular to the base 34.

Along each lateral portion 36, close to a lower free end 37, the central structure 32 has an extension 38, orthogonal to the lateral portion 36 itself, and outside the central structure 32.

This extension 38 is then refolded at the free end towards the base 34 of the structure 32, creating a longitudinal channel 39.

At the side of each portion 36, and outside the structure 32, there is a longitudinal appendage 40, with three identical semicircular housings 41, 42 and 43. More specifically, there is a lateral housing 41, an upper housing 42 and a housing 43, opposite to the housing 42.

From FIG. 5 it can also be deduced that the second portion 50 of the gangway 10 has a second central structure 52, effected by means of an overturned "U"-shaped draw piece, with an upper rectangular base 54 and two lateral portions 56, symmetrical to each other and perpendicular to the base 54.

Along each lateral portion 56, close to a lower free end 57, the central structure 52 has an extension 58, orthogonal to the lateral portion 56 itself, and inside the central structure 52.

This extension 58 thus forms, with the lateral portion 56 and the base 54, a longitudinal guide 60.

Figure 4A:
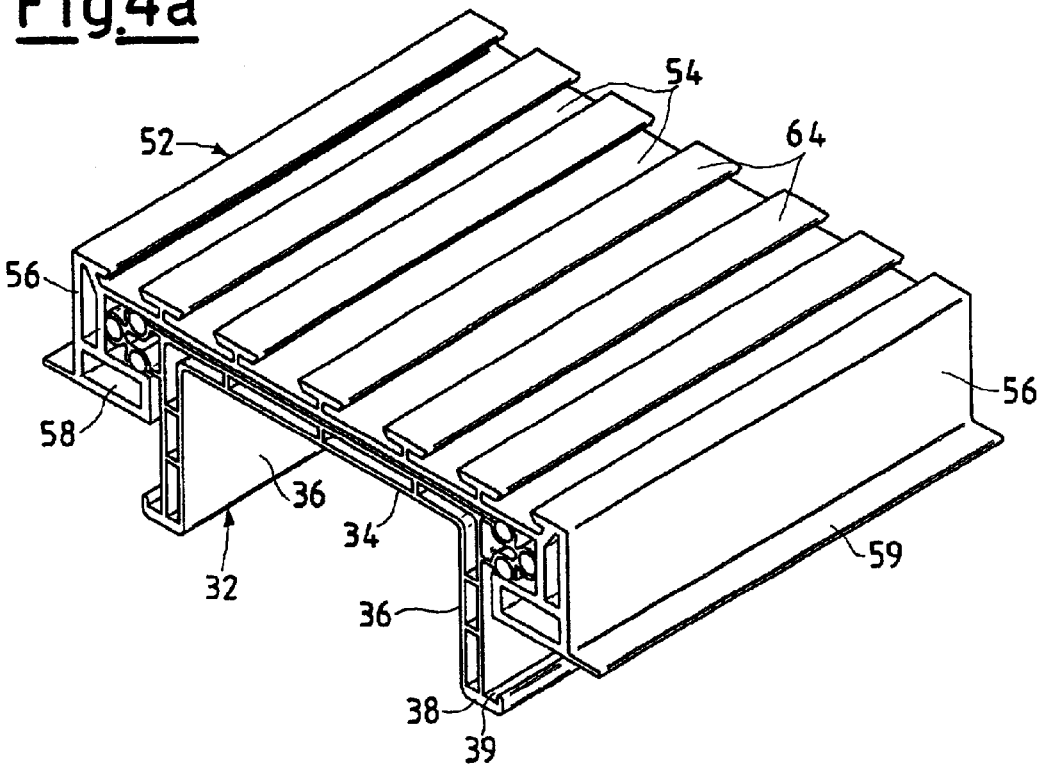
FIG. 4*a* is an axonometric view, which shows the same relative sliding elements between the two telescopic portions of which a section is already shown in FIG. 4.
Figure 4:
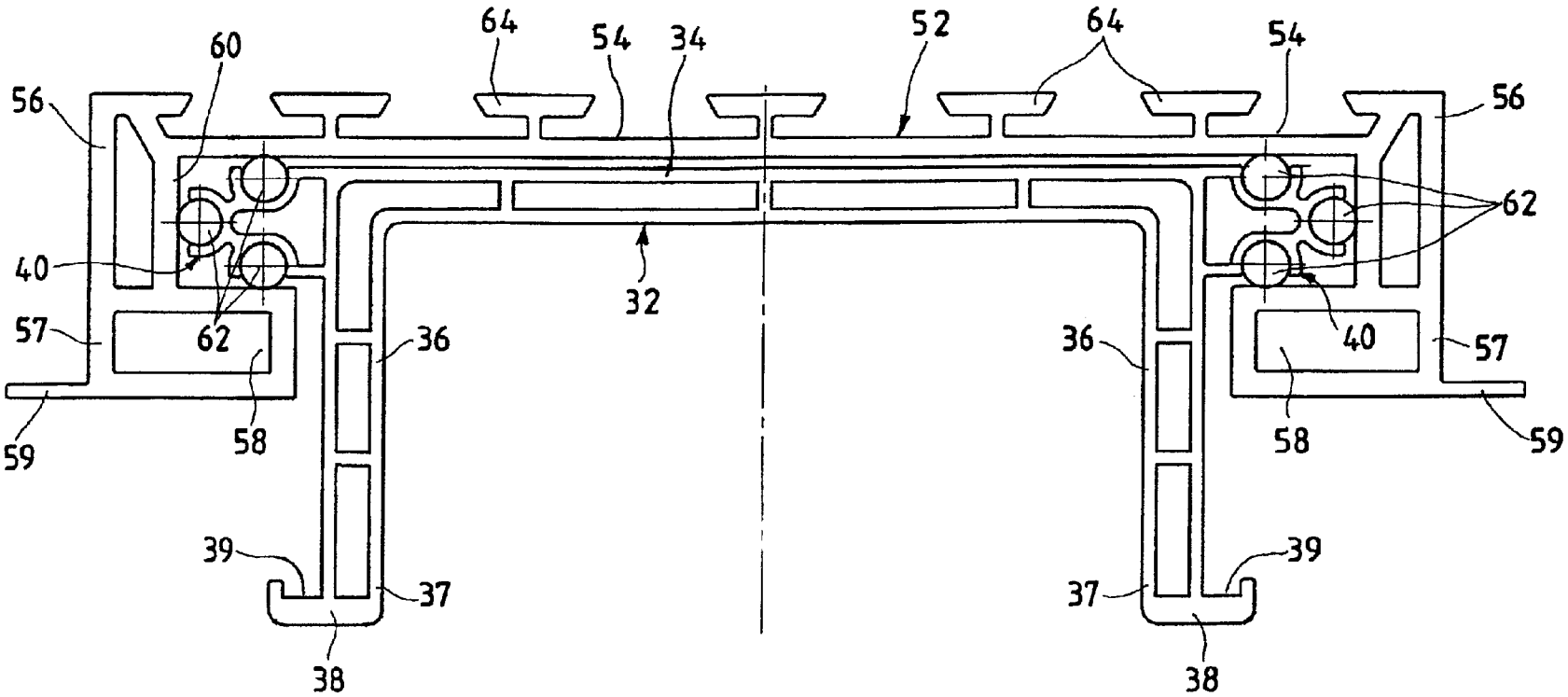
FIG. 4 is a partial enlargement of the transversal section of FIG. 3, showing the relative sliding elements between the two telescopic portions.

As can be seen in FIGS. 4 and 4*a*, this guide 60 is complementary to the longitudinal appendage 40 of the first portion 30, after the insertion of three reciprocal sliding cylinders or bearings or rods or plugs or bushings 62, for example made of Delrin®, nylon, Teflon® or plastic material in general.

Along each lateral portion 56, close to a lower free end 57, the central structure 52 has an extension 59, orthogonal to the lateral portion 56 itself, and outside the central structure 52.

Furthermore, above the base 54 there is a series of "T"-shaped anchorages.

Figure 3:
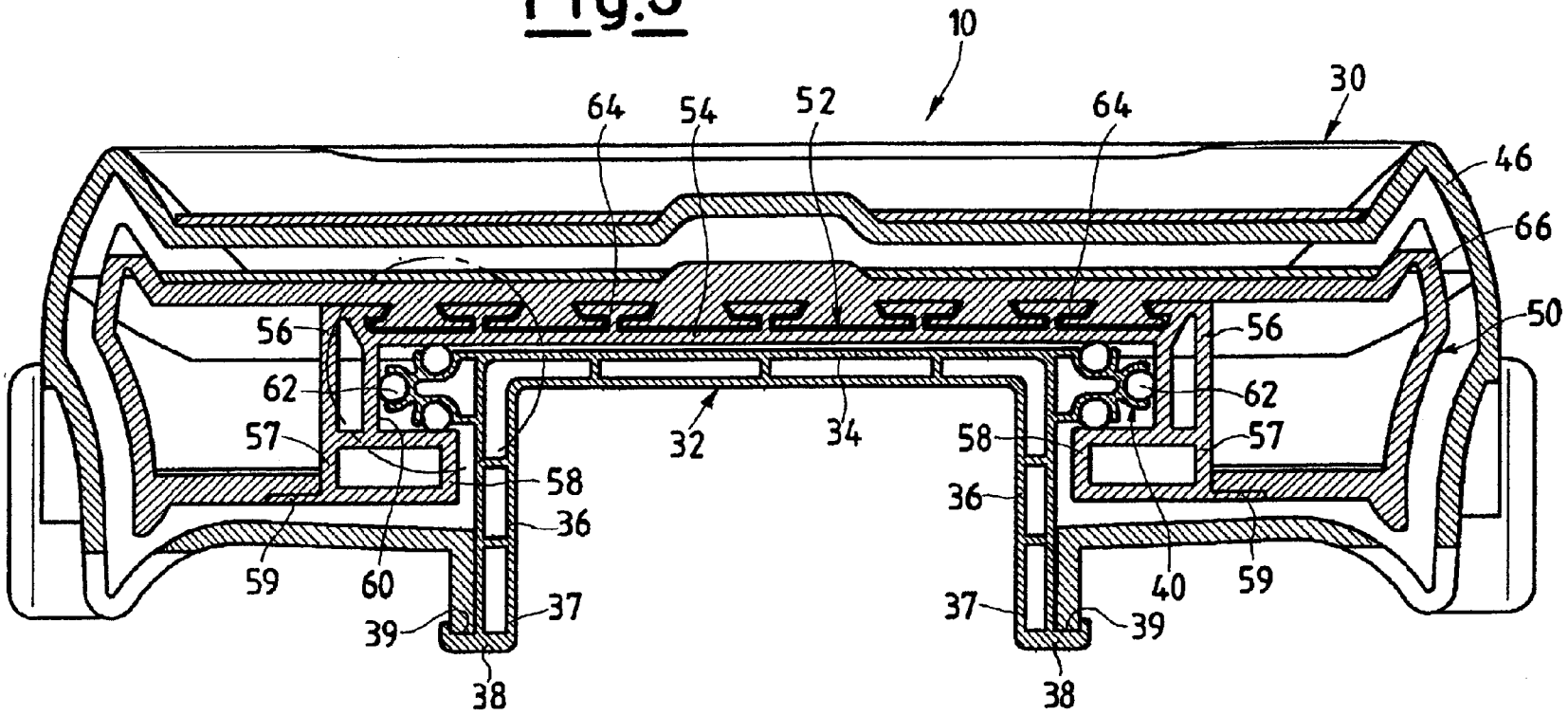
FIG. 3 is a transversal section of the gangway of FIG. 2.

As can be seen in particular from FIG. 3, the walking area of the gangway 10 is produced by lining the second central structure 52 with a covering 66, preferably made of fiberglass or plastic material, and lining the first central structure 32 with a covering 46, again preferably made of fiberglass or plastic material; this assembly allows adequate insertion of the covering 66 inside the structure 46, when the central portion 52 slides outside the structure 32 during the telescopic opening/closing movement of the gangway 10.

More specifically, as the covering 66 has an essentially rectangular sectional structure and is open in a lower central zone where it ends in correspondence with the extensions 59, it covers the top of the base 54 of the structure 52, internally enveloping the anchorages 64, which allow a firm hold between the structure 52 and covering 66.

The covering 46 also has an essentially rectangular sectional structure, open in a central lower zone terminating in correspondence with the longitudinal channels 39 of the portion 32; its size is such as to encircle the covering 66 and the structure 52, when this is inserted outside the structure 32.

The functioning of the telescopic gangway for boats with a simplified construction according to the invention is clear from the description and is basically as follows.

During sailing, the second portion 50 of the gangway is telescopically inserted into the first portion 30. Furthermore, the gangway 10 is kept in a raised position generally by means of the extension of the cylinder 22.

When the boat 12 has been moored, the cylinder 22, whose end 26 is fixed to the first portion 30 of the gangway 10, is withdrawn until it is correctly inclined with respect to the mooring quay or jetty.

At this stage, the second portion 50 of the gangway 10 is extracted, also partially, as required, generally using another hydraulic cylinder, positioned according to a longitudinal axis of the gangway 10. The purpose of this other cylinder is to ensure the reciprocal sliding of the two portions 30 and 50 of the gangway 10.

This reciprocal sliding is effected thanks to the presence of the cylinders 62, for example made of nylon, of which there are three in the non-limiting example shown in FIG. 3. They are fixed to the housings 41, 42 and 43 of the longitudinal appendage 40, against opposite walls of the guide 60.

It should be pointed out that the number of cylinders 62, and correspondingly the number of housings 41, 42 and 43, may vary as required.

The characteristics of the telescopic gangway for boats, with a simplified construction, object of the present invention, are evident from the description, as also the relative advantages, among which:

- simple and reliable use;
- limited weight, consequently also with movement-activating devices having reduced weights and costs;
- simplified construction, with reduced costs with respect to the known art, using materials such as fiberglass for the coverings and draw-pieces made of light alloy for the supporting structures.

Finally, numerous modifications and variations can obviously be applied to the telescopic gangway for boats, with a simplified construction, thus conceived, all included in the invention; furthermore all the details can be substituted by technically equivalent elements. In practice, the materials used, as well as the forms and dimensions, can vary according to technical demands.

The scope of protection of the invention is therefore defined by the enclosed claims.

What is claimed is:

1. A telescopic gangway (10) for a boat (12), said telescopic gangway having a simplified construction comprising at least two portions (30, 50), in which second portion (50) slides inside at least first portion (30) in a longitudinal direction thereto wherein said second portion (50) is equipped with a first central supporting structure (52), which slides on a second central supporting structure (32) of first portion (30); said two central supporting structures (32, 52) being equipped with reciprocal sliding guides (60) and complementary appendages (40) wherein said central supporting structures (32,52) of said first portion (30) and said second portion (50) comprise at least one overturned "U"-shaped draw-piece, with an upper rectangular base (34,54) and lateral portions (36,56) where, at the side of each lateral portion (36,56) there are said complimentary appendages (40) and said sliding guides (60), said second portion of said first central supporting structure (52) being lined with a covering (66) made of fiberglass or plastic material, which can be telescopically inserted into a further covering (46) made of fiberglass or plastic material which lines said second central supporting structure (32) of said first portion (30).

2. The telescopic gangway (10) according to claim 1, wherein said appendages (40) have housings (41, 42, 43) for reciprocal sliding elements (62) between the appendages (40) and said guides (60).

3. The telescopic gangway (10) according to claim 2, wherein said reciprocal sliding elements comprise cylinders, bearings, rods, plugs or bushings (62) made of plastic material.

4. The telescopic gangway (10) according to claim 1, wherein said covering (66) of the second portion (50) has an essentially rectangular sectional structure, open in a lower central zone, where said covering (66) covers a top part of upper base (54) of the first central support structure (52) and ends laterally in correspondence with the said lateral portions (56) of the first central support structure (52) itself, and in that said covering (46) also has an essentially rectangular sectional structure, open in a lower central zone, where said covering (46) is of such a size as to encircle the covering (66) and said first central support structure (52) is inserted on the outside of said second central support structure (32) and said covering (46) ends laterally in correspondence with the lateral portions (36) of the central support structure (32).

5. The telescopic gangway (10) according to claim 4, wherein said covering (66) covers the top part of the base (54) of the structure (52), internally enveloping "T"-shaped anchorages (64), whose purpose is to guarantee a firm hold between structure (52) and covering (66).

6. The telescopic gangway (10) according to claim 1, wherein the first portion (30) of the gangway (10) is rotatively connected to the boat (12) in correspondence with one of its ends.

7. The telescopic gangway (10) according to claim 6, wherein said rotatively connected gangway is obtained by means of a cylindrical pin (14) which passes through a hole (16) situated at the end of the gangway (10), and a "U"-shaped clamp (20), fixed to the boat (12), said rotation of the first portion (30) of said gangway (10) around the axis of the pin (14), is effected by means of a hydraulic cylinder (22), rotatingly fixed at its first end (24) to the boat (12), below clamp (20), and at its opposite end (26) to the first portion (30) of gangway (10).

* * * * *